US006994005B2

(12) United States Patent
Lamothe

(10) Patent No.: US 6,994,005 B2
(45) Date of Patent: Feb. 7, 2006

(54) APPARATUS FOR SLITTING, MERGING, AND CUTTING A CONTINUOUS PAPERWEB

(75) Inventor: Richard P. Lamothe, Burlington, CT (US)

(73) Assignee: Energy Saving Products and Sales Corp., Burlington, CT (US)

( * ) Notice: Subject to any disclaimer, the term of this patent is extended or adjusted under 35 U.S.C. 154(b) by 0 days.

(21) Appl. No.: 10/087,559

(22) Filed: Mar. 1, 2002

(65) Prior Publication Data

US 2003/0164103 A1 Sep. 4, 2003

(51) Int. Cl.
*B26D 11/00* (2006.01)

(52) U.S. Cl. ..... 83/156; 83/425.3; 83/408; 226/21

(58) Field of Classification Search ..... 242/615.21, 242/525, 548; 226/21, 196.1; 83/156, 408, 83/425.3, 425.4
See application file for complete search history.

(56) References Cited

U.S. PATENT DOCUMENTS

| | | | | | |
|---|---|---|---|---|---|
| 265,556 | A | * | 10/1882 | Anthony et al. | 270/52.08 |
| 1,348,553 | A | * | 8/1920 | Dowell | 270/5.01 |
| 2,214,593 | A | * | 9/1940 | Mustin | 83/29 |
| 2,284,318 | A | * | 5/1942 | Hamlin | 493/321 |
| 3,399,884 | A | * | 9/1968 | Bahrani | 270/52.08 |
| 3,732,770 | A | * | 5/1973 | Ottavan | 83/572 |
| 3,912,143 | A | * | 10/1975 | Miller et al. | 226/3 |
| 4,788,846 | A | * | 12/1988 | Morita et al. | 72/160 |
| 4,846,504 | A | * | 7/1989 | MacGregor et al. | 283/102 |
| 4,939,888 | A | | 7/1990 | Katz et al. | |
| 5,016,801 | A | * | 5/1991 | Gilat et al. | 242/615.21 |
| 5,100,117 | A | * | 3/1992 | Hajek et al. | 270/52.08 |
| 5,104,104 | A | | 4/1992 | Mol | |
| 5,466,321 | A | * | 11/1995 | Miyaji | 156/260 |
| 5,520,317 | A | | 5/1996 | Eckert et al. | |
| 5,779,233 | A | | 7/1998 | Schweiger | |
| 5,823,464 | A | | 10/1998 | Bohn et al. | |
| 5,947,461 | A | | 9/1999 | Holbrock | |
| 5,953,971 | A | | 9/1999 | Jacques | |
| 5,996,491 | A | * | 12/1999 | Kishine et al. | 101/223 |
| 6,004,432 | A | | 12/1999 | Page et al. | |
| 6,027,003 | A | | 2/2000 | Gassner | |
| 6,047,922 | A | | 4/2000 | Michalik | |
| 6,092,761 | A | | 7/2000 | Mushaben | |
| 6,125,730 | A | | 10/2000 | Jacques | |
| 6,244,584 | B1 | | 6/2001 | Holbrook et al. | |
| 2003/0047644 | A1 | * | 3/2003 | Michalik et al. | 242/615.21 |

* cited by examiner

*Primary Examiner*—Kenneth E. Peterson
(74) *Attorney, Agent, or Firm*—McCormick, Paulding & Huber LLP

(57) ABSTRACT

A paper web, which may be pinless, is slit into side-by-side web ribbons that are merged one on top of the other for simultaneous crosscutting into appropriate page lengths. One web ribbon wraps substantially about an angled turnbar to shift it into registry with the other web ribbon. Pressurized air may be provided to the turnbar assembly to reduce friction with the web ribbon. The other web ribbon is detoured via a takeup roller by an amount that is dictated by the circumference of the turnbar assembly. A driven roller in continuous contact with one of the web ribbons draws it toward a cross cutter. A slave roller is in slipping contact with the remaining web ribbon and draws it toward the same crosscutter to maintain registry between the ribbons. Three-up, four-up, and more-up variations are disclosed.

1 Claim, 4 Drawing Sheets

APPARATUS FOR SLITTING, MERGING, AND CUTTING A CONTINUOUS PAPERWEB

FIELD OF THE INVENTION

The present invention relates generally to an apparatus for slitting a paperweb into at least two side-by-side web segments or ribbons, merging these paperweb ribbons one on top of the other, and cutting the merged webs in accurately indexed relationship with respect to one another for later sequentially collating the pages. More particularly, the present invention permits handling a "pinless" continuous paperweb, that is a web without tractor drive perforations along the marginal edges of the web such as have been relied upon for such slitting, merging, and cutting operations in the past.

BACKGROUND OF THE INVENTION

Present day print shops utilize laser printers to print the pages of a book or job on a continuous paperweb that is typically wider than needed for the printed pages. Printers are generally set up to print successive pages in side-by-side relationship on the relatively wide paperweb. The web is then slit into at least two side-by-side web ribbons that ideally are then collectively crosscut after the web segments or ribbons are arranged in registry one above the other. However, accurate registration or merger of the side-by-side web ribbons has been facilitated heretofore by the tractor fed perforated paperweb. More particularly, by feeding the slit web segments with the tractor drive engaging only one marginal side of the web segments, those segments were successfully merged and fed into a rotary cutter so the pages can be simultaneously cross-cut from the web ribbons.

Present day laser print shops utilize the pinless (non-tractor) paper roll now available and no longer require the perforated paperweb used with such tractor drives. There is a corresponding need for a pinless paper merger system for accurately indexing the web ribbons one on top of another in order that a rotary cutter can sever the web ribbons such that the printed matter is presented on individual successive pages.

SUMMARY OF THE INVENTION

In accordance with the present invention, a paper web handling apparatus is provided wherein a paper web is continuously fed in a downstream direction from a utilization device, the downstream direction determined by the movement of the paperweb through the apparatus. The apparatus comprises a slitter downstream of the utilization device that divides the web into at least a first and a second web ribbon so that the web ribbons are in side by side relation. A cutter is also provided downstream of the slitter that is capable of transversely cutting the web ribbons, transverse being at a substantial angle (substantial being >45°) relative to the downstream direction of the web. Preferably, the transverse angle is perpendicular to the downstream direction of the web. The apparatus further comprises a driven master roller that draws either the first or the second web ribbon at a speed related to that of the utilization device, and this driven master roller is adjacent to the cutter. The apparatus also comprises at least one slave roller that draws the other of the first or the second web ribbon at a speed at least equal to that of the driven master roller. The slave roller is also adjacent to the cutter. Finally, the apparatus comprises a first turnbar assembly between the slitter and the cutter for shifting the second web ribbon laterally relative to the downstream direction. This orients the second web ribbon in vertical alignment with the first web ribbon, one on top of the other, so both web ribbons move through the cutter simultaneously.

DETAILED DESCRIPTION

Figure 1:
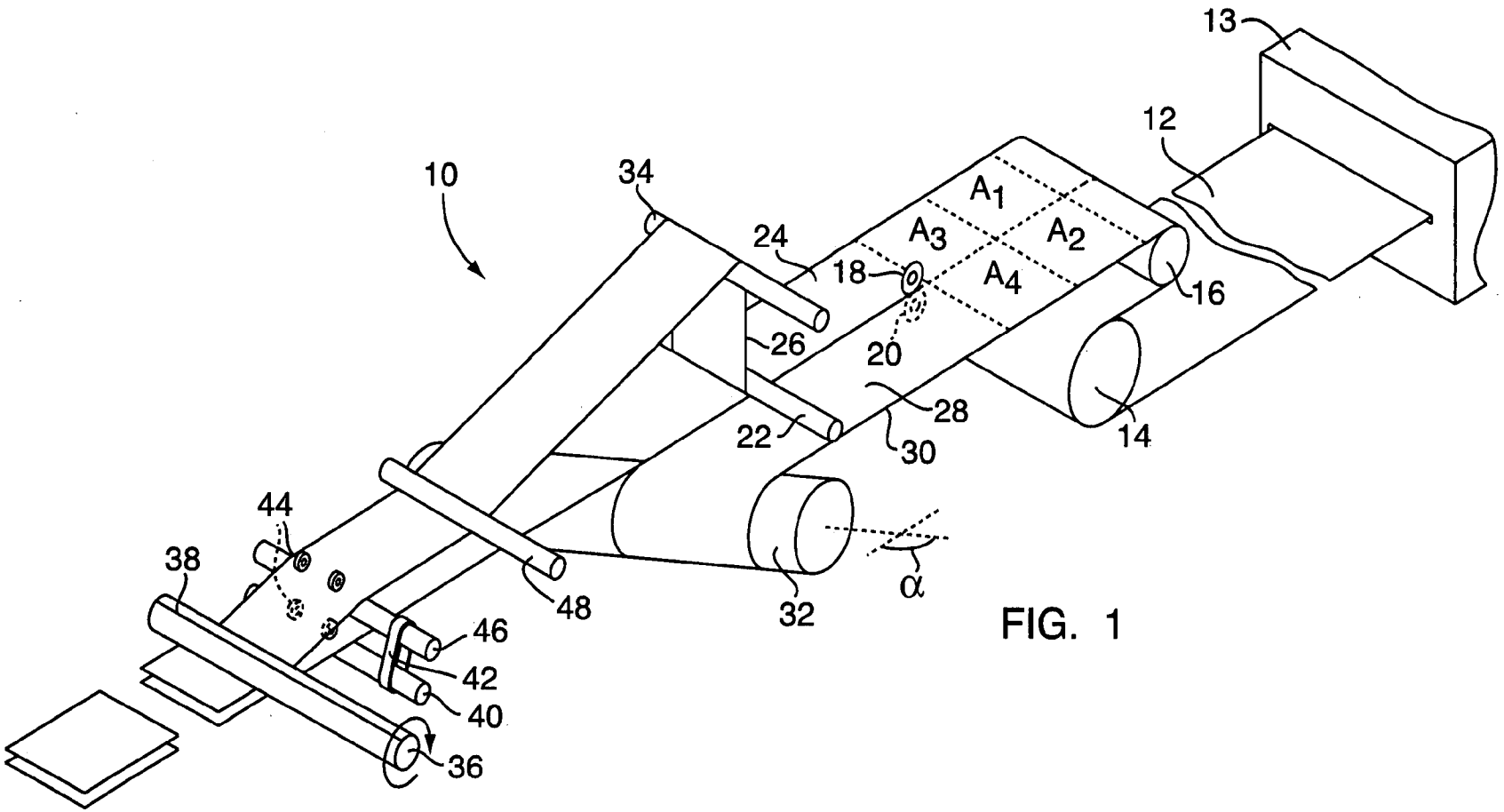
FIG. 1 is a perspective view of the invention illustrating a paperweb being slit, merged, and crosscut in a two-up process.

Turning now to the drawings in greater detail, FIG. 1 shows the preferred embodiment of a web slitting and merging apparatus 10 of the present invention operating on a paperweb 12 of the pinless variety (pinless meaning no perforations in the marginal edges). While the term paperweb 12 is used herein, it will be appreciated that this invention is not limited to paper but may operate on foil, fabric, plastic sheeting, or any other such flexible continuous roll or sheet of material. The paperweb 12 travels from the right of FIG. 1 to the left, moving from an upstream utilization device 13 such as a laser printer to the apparatus 10 of the present invention. The paperweb 12 enters the apparatus 10 having printed material on one or both of its faces, such as in the areas indicated at "$A_1$", "$A_2$", "$A_3$" and "$A_4$" etc. In a common application, the sections "$A_1$", "$A_2$", "$A_3$" and "$A_4$" etc. comprise the pages of a book or job when the paperweb 12 is ultimately slit and cut, all in accordance with conventional practice for paperwebs of the variety having tractor drive holes in their marginal edges.

A tension-free loop (not shown) is generally provided between the upstream laser printer and the apparatus 10 of FIG. 1. The reader is referred to U.S. Pat. No. 5,505,401 for a detailed explanation of how a tension free loop, between a braked/drag roller and a laser printer can be held to a constant droop or depth so as to match the speed of the laser printer to a downstream/output device (which in the '401 patent happens to be a rewind machine). Co-owned U.S. Pat. No. 5,505,401 is hereby incorporated by reference. In the present disclosure, the apparatus 10 of FIG. 1 replaces the rewind machine of the '401 patent to match the speed of operation of one web processing apparatus to the laser printer (or any such web utilization device). An electromagnetically operated brake is provided on a drag roller 14 so as to create tension between the upstream utilization device and the apparatus 10 to be described. The paperweb 12 subsequently travels across a setup roller 16 for proper orientation of the web. The drag roller 14 is preferable to ensure proper tensioning of the web 12 as it enters the apparatus 10.

The paperweb 12 is cut lengthwise as it travels across a slitter. The particular slitter illustrated comprises a rotary upper blade 18 provided above the plane of the web 12 that cooperates with a slightly offset scissor blade 20 in accordance with conventional practice. Any of the various slitters known in the art may be substituted herein without departing from the inventive aspects of this disclosure.

The slitter provides two side-by-side web ribbons illustrated as a first web ribbon 24 defining a slit edge 26, and a second web ribbon 28 defining a lateral edge 30. While two equal width web ribbons are shown, it will be appreciated that more slitters may be employed to divide a web into numerous ribbons that need not be of equal width. The web ribbons 24 and 28 pass under a splitting roller 22, after which their courses diverge. The pages labeled $A_1$ and $A_3$ remain on the first web ribbon 24, and the pages labeled $A_2$ and $A_4$ remain on the second web ribbon 28.

The second web ribbon 28 wraps around a large diameter turnbar roller 32 that is canted at an angle $\alpha$ relative to the general downstream direction of the paperweb. The turnbar roller 32 causes the second web ribbon 28 to shift laterally and come into registered relationship under the first web ribbon 24. The extent of this lateral shift is a function of the angle $\alpha$ and the diameter of the turnbar roller 32. These parameters are set so the lateral edge 30 of the second web ribbon 28 moves into vertically alignment with the slit edge 26 of the first web ribbon 24. The angle $\alpha$ may be adjustable to vary the lateral shift depending upon the print job. The preferred embodiment employs a turnbar that is mounted so as to enable the angle $\alpha$ to be adjustable with respect to the downstream direction of web travel, to accommodate print jobs that entail side by side web ribbons of differing width. Where web ribbons define different widths, a simple adjustment of the angle $\alpha$ or the circumference of the turnbar roller 32 will result in alignment of the opposite edges of the web ribbons 24, 28 if so desired. When more than two web ribbons are cut, a turnbar roller 32 will be employed for each of the web ribbons excepting one. This is the second alternative embodiment shown in FIG. 3 and explained below.

An adjustable upper take-up roller 34 is provided to detour the first web ribbon 24 a length corresponding to the circumferential wrap about the turnbar roller 32 mentioned previously. The upper take-up roller 34 is preferably adjustable to extend or contract the linear path of the first web ribbon 24 so as to match various sizes of turnbar rollers 32 or other variances in the path of web travel for the second web ribbon 28. This ensures the web ribbons 24, 28 are in registered relationship with each other even without indexing their forward travel via marginal perforations, as used in prior art slitting and merging apparatus. Of course, the present invention works equally well where the web does include such marginal perforations, but they are unnecessary to ensure proper registry.

As a result of the canted turnbar roller 32 and its handling of the second web ribbon 28 coupled with the detour imposed on the first web ribbon 24 by the adjustable upper take-up roller 34, the web ribbons 24 and 28 are provided in registered relation one above the other. These vertically aligned web ribbons are then collectively cut transversely, or crosscut, at appropriate locations to provide the pages of the book or job.

The length of the pages to be crosscut taken in combination with the speed of the paperweb 12 and web ribbons 24 and 28 dictates the rotational speed of a rotary cutter 36. Preferably a servo motor drives the rotary cutter 36, which cuts the web ribbons 24 and 28 transversely by means of a blade 38 mounted thereon in cooperation with a fixed blade (not shown) located below the web ribbons 24, 28. This transverse cut separates, for example, page $A_1$ from page $A_3$ on the first web ribbon 24, and page $A_2$ from page $A_4$ on the second web ribbon 28. In this manner, the pages are crosscut and stacked in their desired consecutive order. The present invention thereby provides an improved method of handling continuously fed paperweb, particularly paperweb of the pinless variety, which does not afford the luxury of being handled by tractor drive arrangements typical of prior art web machinery. A DC motor preferably drives the driven master roller 40. Backup wheels 44 are provided for maintaining contact between the driven master roller 40 and the second web ribbon 28 so that no slippage occurs between them.

A timing belt 42 driven by the master roller 40 causes rotation of a slave or slipping roller 46 that loosely engages the underside of the first web ribbon 24. The slave roller 46 drives the first web ribbon 24 at a speed equal to or greater than that of the driven master roller 40. This speed variance is enabled by differing the circumference of the two rollers, by gearing through which the timing belt 42 is attached, or any other means known in the art. The slave roller 46 also has associated backup wheels 44 as shown in FIG. 1, which are spaced to allow slippage between the slave roller 46 and the first web or ribbon 24. Thus, the first web ribbon 24 is continuously drawn in the downstream direction by the slipping roller 46 so as to avoid any relative movement between the first and second web ribbons 24 and 28 at the rotary cutter 36. An alignment roller 48 may be provided to ensure the first web ribbon 24 maintains sufficient contact with the slave roller 46, regardless of the position of the upper take-up roller 34. The blade 38 on the rotary cutter 36 moves clockwise as shown in FIG. 1, and its speed is timed to that of the driven master roller 40 and the moving web ribbons 24 and 28 to assure appropriate page length as mentioned previously. The master roller 40 is driven against its backup wheels 44 creating tension in the second web ribbon 28. No slippage should occur between the second web ribbon 28 and the master driven roller 40.

The second web ribbon 28 need not wrap 360° about the turnbar roller 32. Imposed friction may be diminished by wrapping the web ribbon somewhat less than completely about the turnbar roller 32 and employing a standard turnbar to realign the web with its proper path at the proper angle. This embodiment requires the ribbon 28 wrap more than 180° about the turnbar roller 32 to account for the large diameter of the roller 32. Less of a wrap would require two or more standard turnbars to realign the second web ribbon 28 with the first web ribbon 24, defeating the purpose and simplicity of a large diameter roller to provide for the lateral shift.

Figure 2:
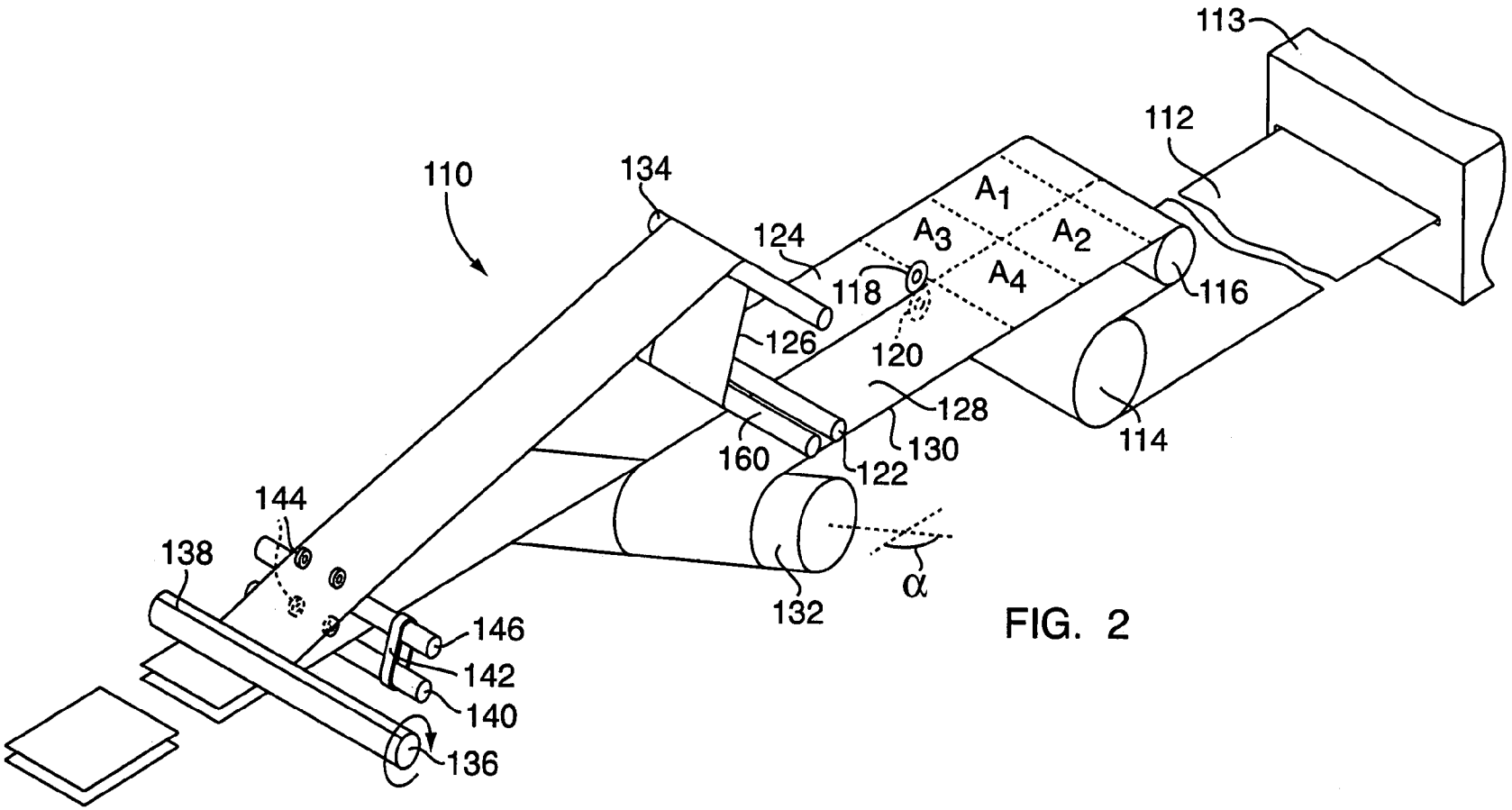
FIG. 2 is a perspective view of the first alternative embodiment that requires less vertical space than FIG. 1.

A first alternative embodiment is presented in FIG. 2, wherein each feature is the same as that of the preferred embodiment of FIG. 1 excepting the mechanism by which the first web ribbon is detoured. Using the convention that like components of this alternative embodiment are numbered 100 greater than like components of the preferred embodiment, the second web ribbon 128 passes about the turnbar roller 132 and the master roller 140 substantially as described in FIG. 1. This alternative embodiment is designed to minimize the vertical extent of the entire apparatus 110. The first web ribbon 124 passes under a lower take-up roller 160 and about the upper take-up roller 134 before proceeding toward the slave roller 146. The lower take-up roller 160 is added in this alternative embodiment so that the upper take-up roller 134 may remain either fixed, or adjustable only in the horizontal plane. As previously explained, the diameter of the turnbar roller 132 (or the number of times a web ribbon wraps about that turnbar) determines the additional distance to be imposed on the first web ribbon 124 path of travel. The embodiment of FIG. 2 allows this distance to be accomodated by moving the upper 134 and lower 160 take-up rollers further apart without the need for additional vertical space as in the preferred embodiment. The distance of travel for the first web ribbon 124 may be increased by moving the lower take-up roller 160 toward the rotary cutter 136, by moving the upper take-up roller 134 further from the rotary cutter 136, or both. A spring (not shown) is provided to bias the lower 160 and/or upper 134 take-up rollers apart and is resisted by tension in the first web ribbon 124. This bias maintains a relatively constant tension in the web over various distances between the take-up rollers, since the difference between the nearest and farthest practical positions for the rollers does not vary greatly. In any instance, care must be taken that there is sufficient space between various sections of the web ribbons so they do not contact themselves or each other, which would greatly increase the risk of tears and misalignment. Due to the more vertically restrained extent of the upper take-up roller 134, an alignment roller (48 in FIG. 1) is generally unnecessary in this first alternative embodiment. The limited height of the upper take-up roller 134 ensures the first web ribbon 128 remains sufficiently aligned to properly contact the slave roller 146.

Figure 3:
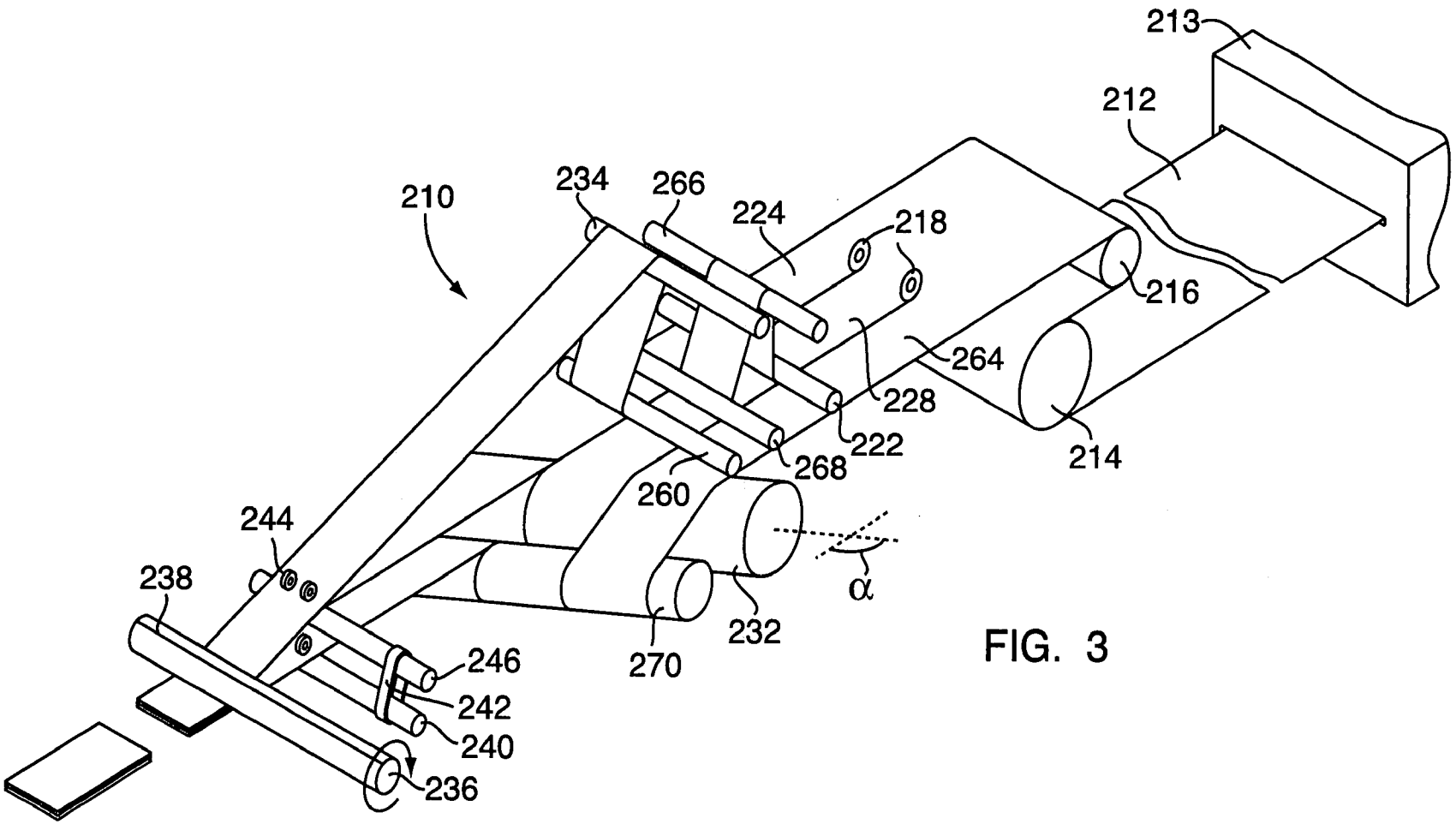
FIG. 3 is a perspective view of a second alternative embodiment that slits the web into three ribbons, then merges and crosscuts them in a three up process.

The previous two embodiments are largely limited to two-up processing, where successive pages are printed in lateral pairs that are slit and stacked two at a time. Modifying either of the previous two embodiments with additional slitters and turnbar rollers enables the present invention to perform three-up or four or more-up processing. This is where three or more pages are printed on the web in side-by-side fashion which are then slit, crosscut and stacked so that each page previously side-by-side is now consecutive one on top of the other, as in the pages of a book. A second alternative embodiment depicting three-up processing is shown in FIG. 3. Modifications for more than three side-by-side pages flow logically from this second alternative embodiment by the addition of more slitters and turnbar rollers.

Three-up processing is similar to two-up processing described in FIGS. 1 and 2 with several additional components. As before, like components of this second alternative embodiment are numbered 200 greater than like components of the preferred embodiment and 100 greater than the alternative embodiment. The web is moving upstream from a utilization device 213 and is slit by two rotary upper blades 218 and their corresponding offset scissor blades (not shown) into a first web ribbon 224, a second web ribbon 228, and a third web ribbon 264. The first web ribbon 224 follows the path described above for the first alternative embodiment of FIG. 2. The second web ribbon 228 follows a path described above for either of the embodiments of FIGS. 1 or 2, with an additional detour along a path between a midway upper take-up roller 266 and a midway lower take-up roller 268. In this second alternative embodiment, the lower take-up roller 260 is fixed and the upper take-up roller 234 is moveable, so that the length of travel for the first web ribbon 224 is determined by the position of the upper takeup roller 234. The midway lower take-up roller 268 is fixed as movement thereof will not appreciably change the length of travel for the second web ribbon 228. That length is changeable by the vertical adjustment of the midway upper take-up roller 266.

Unlike previous embodiments, two web ribbons 224 and 228 pass between the slave roller 246 and its associated backup wheels 244. This second alternative embodiment preferably employs driven backup wheels 244 associated with the slave roller 246 to reduce slippage between the first web ribbon 224 and the second web ribbon 228. Otherwise, the first web ribbon 224 would be drawn toward the rotary cutter 236 merely by friction with the second web ribbon 228 against the backup wheels 244. While this latter arrangement is possible and works sufficiently when the backup wheels are taut against the web ribbon and the web speed is limited, employing driven backup wheels as an additional slave roller more positively controls the flow of each web ribbon. Employing a single driven roller (or equivalent) to draw in more than two web ribbons is not sufficiently reliable to maintain registered relation between the pages to be crosscut. While nip wheels or backup wheels 244 are shown, any driven body that transfers at least some of its own rotational motion into linear motion of the web ribbon is an equivalent to a slave roller. Thus, rollers, wheels, rotating brushes, and the like are equivalents to the backup wheels 244 for the above function, and so long as they are driven, they are equivalent to the slave roller 246.

The third web ribbon 264 passes under the splitting roller 222, the midway lower take-up roller 268, and the lower take-up roller 260. The third web ribbon 264 then passes over the turnbar roller 232 but not about it, and passes two times about a second turnbar roller 270. The second turnbar roller 270 preferably includes perforations on its arcuate surface through which pressurized gas may escape, described more fully below in association with FIG. 4. For simplicity, the angle $\alpha$ previously described is adjusted to be the same for both the turnbar roller 232 and the second turnbar roller 270 whenever possible. Whereas the second web ribbon 228 wraps once about the turnbar roller 232, the third web ribbon 264 wraps twice about the second turnbar roller 270 to achieve the greater lateral shift as depicted. The diameter of the turnbar rollers, the number of times (or number of degrees about a turnbar's surface) that a web wraps about a turnbar roller and the angle $\alpha$ may each be adjusted for either or both of the first or second turnbar rollers to bring the web ribbons into aligned and registered relation. The 720° wrap of the third web ribbon 264 about the second turnbar roller 270 does impose appreciably more friction than the 360° wrap of the second web ribbon 228.

The three-up arrangement as depicted in FIG. 3 will process sheets so that they are stacked in the same order they are printed side-by-side on the web, that is, a page from ribbon 224 on top of a page from ribbon 228 on top of a page from ribbon 264. This is the typical printing method. However, the order of these stacked pages can be changed merely by threading the ribbons differently through the apparatus. For example, in the embodiment of FIG. 3, the position of the turnbar roller 232 and the second turnbar roller 270 can be interchanged so that the turnbar roller 232 is more downstream. This will result in the second web ribbon 228 passing over the second turnbar roller 270 prior to its single wrap about the turnbar roller 232 and being drawn toward the rotary cutter 236 by the master driven roller 240 (instead of the slave roller 246). The third web ribbon 264 will pass twice about the second turnbar roller 270 and subsequently pass over the turnbar roller 232. The third web ribbon 264 will then come into alignment with the first web ribbon 224 vertically between the first 224 and the second 228 ribbon, rather than below both as depicted in FIG. 3. The third web ribbon 264 is drawn in by the slave roller 246 instead of the master driven roller 240. The resulting cut pages are arranged first web ribbon-third web ribbon-second web ribbon as read top to bottom, as opposed to the arrangement of FIG. 3 which yields first web ribbon-second web ribbon-third web ribbon. Thus any ribbon may be threaded so that its resulting pages fall in any position relative to the other pages, so long as the first web ribbon 224 remains on the top of a sequential stack of pages and the sequence retains one page from each ribbon before repeating.

It can be appreciated that a fourth web ribbon may be processed by the addition of another slitter and turnbar assembly imposing a path similar to that of the second web ribbon 228 of FIG. 3. Assuming this fourth web ribbon is located outboard of the third web ribbon 264 of FIG. 3, it would pass as the third web ribbon 264 is depicted in FIG. 3 excepting it would pass over but not about the second turnbar roller 270, and instead pass three times about a third turnbar roller. The path of the third web ribbon 264, as depicted in FIG. 3 but with an adjacent outboard fourth web ribbon, would pass about one or more takeup rollers to account for the increased path distance. Each ribbon will preferably have contact with a driven roller, wheels or the like to draw it toward the rotary cutter 236, or at least no more than two web ribbons will be drawn toward the cutter by a single driven roller. Further ribbons may be added by repeating the iteration progressing from FIGS. 2 to 3 to this paragraph, adding more slitters, take-up rollers, turnbar rollers, and driven means to draw the new ribbon toward the rotary cutter.

Figure 4:
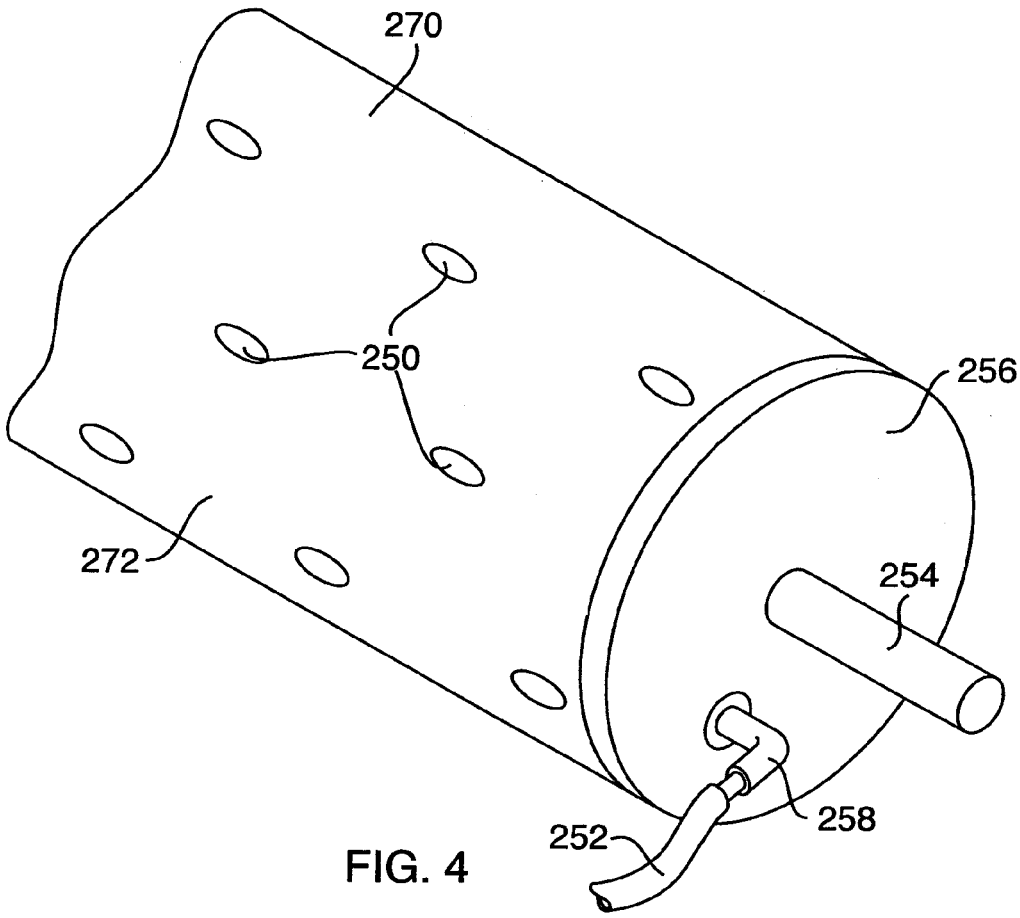
FIG. 4 is a perspective view of the second turnbar roller of FIG. 3 in isolation, incorporating perforations and a supply means for pressurized gas.

FIG. 4 shows the second turnbar roller 270 in isolation wherein the second turnbar roller 270 is provided with perforations 250 through its cylindrical walls and an air hose 252 that provides pressurized air to its interior. A web ribbon wrapped more than 360° about a turnbar, such as the third web ribbon 264 about the second turnbar roller 270 of FIG. 3, tends to induce significant friction. The embodiment of FIG. 3 preferably includes a second turnbar roller 270 with perforations along its arcuate surface 272 and an air system that countervails such friction. The second turnbar roller 270 is mounted via a shaft 254 along its longitudinal axis, though the second turnbar roller 270 does not rotate. Over each end of the second turnbar roller 270 is a form-fitting cap 256. At least one cap 256 has one or more openings through which protrude the shaft 254 and an air hose fitting 258 for easy connection of a conventional air hose 252 or tube. The corresponding cap 256 at the opposite end of the second turnbar roller 270 (not shown) need not incorporate this air hose fitting 258. The air hose 252 provides pressurized air into an interior cavity of the second turnbar roller 270, which passes out through the perforations 250. A web ribbon (not shown) wrapped around such a pressurized second turnbar roller 270 will 'ride' on this cushion of air and pass about the second turnbar roller 270 with significantly less friction than otherwise. While a pressurized turnbar arrangement as in FIG. 4 may reduce friction in both the preferred and first alternative embodiments, it has proven unnecessary for the best mode in those embodiments. The advantages of such a pressurized turnbar are more acute where a web ribbon wraps more than once, or more than 360°, about a turnbar.

When space limitations are a factor, the arrangements of FIGS. 1–3 above may be inverted wherein the turnbar roller is located (or are located) above rather than below the horizontal plane of the slitter, and the take-up roller is located below that level. Combinations may also be employed, wherein some web ribbons travel about a turnbar roller above and some web ribbons travel about a turnbar roller below the horizontal plane of the slitter, and web ribbons are brought into alignment from both above and below that plane.

One further advantage of the present invention is that paper may be fed and crosscut without necessarily being slit or merged. When larger pages are desired, the slitter may be retracted and a single, wide swath of paper will pass through to the rotary cutter. Alternatively, the slitter may be retained and the ribbons may not be merged so as to yield side-by-side stacks of pages, such as where consecutive pages of a print job are not printed in side by side relation but one after another within the same ribbon of the web. This bypassable characteristic is particularly valuable to smaller print shops whose equipment must be made to serve multiple purposes, and is a feature largely absent from many of the devices currently available to slit and merge paperweb.

Modifications and variations of the above described embodiment will be apparent to those skilled in the art consistent with the teaching of this disclosure. The scope of the following claims encompasses such modifications and variations in accordance with the Doctrine of Equivalents.

What is claimed is:

1. An apparatus for slitting and merging ribbons from a preprinted paper web so that the ribbons can be superposed one on top of the other and synchronized to one another for simultaneous severing at a single cutting station, said apparatus comprising:

a slitting station configured to slit the paper web into at least first and second ribbons;

a turnbar roller angled with respect to a downstream direction of travel of the paper web, wherein the first ribbon is wrapped around the turnbar roller for laterally shifting the first ribbon, whereby the first and second ribbons are superposed one above the other downstream of said slitting station;

a ribbon drive station configured to draw the web and first and second ribbons in the downstream direction of travel;

a single cutting station configured to simultaneously cut the superposed first and second ribbons; and a take up mechanism positioned between the slitting station and cutting station for substantially duplicating the path length of the second ribbon relative to the first ribbon without lateral displacement of the second ribbon, said take up mechanism comprising:

an upper take up roller positioned perpendicularly to the direction of movement of the second ribbon; and a lower take up roller lying forward of the upper take up roller and positioned perpendicularly to the direction of movement of the second ribbon and parallel to the upper take up roller, said second ribbon passing under the lower take up roller and extending around the upper take up roller, wherein the upper and lower take up rollers are biased apart for tensioning the second ribbon, and wherein at least one of the upper take up roller and the lower take up roller is adjustable in a horizontal direction for adjusting the path length of the second ribbon relative to the first ribbon while minimizing the vertical height of the apparatus, an additional turnbar roller smaller in diameter than the first turnbar roller and associated with a third ribbon created at said slitting station, and take up rollers associated with said third ribbon for substantially duplicating the path length of the third ribbon relative to the first and second ribbons.

* * * * *